US007563005B2

(12) United States Patent
Yatsuda et al.

(10) Patent No.: US 7,563,005 B2
(45) Date of Patent: Jul. 21, 2009

(54) LIGHT SOURCE MODULE AND LAMP EQUIPPED WITH THE SAME

(75) Inventors: Yasushi Yatsuda, Tokyo (JP); Takashi Ebisutani, Tokyo (JP); Takuya Kushimoto, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 5 days.

(21) Appl. No.: 10/962,992

(22) Filed: Oct. 13, 2004

(65) Prior Publication Data

US 2005/0083686 A1 Apr. 21, 2005

(30) Foreign Application Priority Data

Oct. 17, 2003 (JP) ..... 2003-357827

(51) Int. Cl.
*F21V 29/00* (2006.01)

(52) U.S. Cl. ..... 362/373; 362/294; 362/245; 362/800

(58) Field of Classification Search ..... 362/373, 362/294, 245, 247, 464–466
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 5,688,042 | A * | 11/1997 | Madadi et al. | 362/240 |
| 6,362,468 | B1 * | 3/2002 | Murakami et al. | 250/221 |
| 6,618,123 | B2 * | 9/2003 | Uomori et al. | 356/3.12 |
| 6,848,819 | B1 * | 2/2005 | Arndt et al. | 362/545 |
| 6,857,762 | B2 * | 2/2005 | Shimokawa et al. | 362/245 |
| 6,976,775 | B2 * | 12/2005 | Koike | 362/545 |
| 7,011,430 | B2 * | 3/2006 | Chen | 362/235 |

FOREIGN PATENT DOCUMENTS

JP 2002-100217 4/2002

* cited by examiner

*Primary Examiner*—Jong-Suk (James) Lee
*Assistant Examiner*—Leah S Lovell
(74) *Attorney, Agent, or Firm*—Cermak Kenealy Vaidya & Nakajima LLP

(57) ABSTRACT

A modular LED can include an LED chip, a base, and a lens. The lens preferably has a focus at a position spaced a certain distance behind the base to form a virtual light source image of the LED chip. Plural modular LEDs can be integrated into a lamp such that virtual light source images are superimposed. Thus, a light source module can serve as a single light source.

18 Claims, 4 Drawing Sheets

LIGHT SOURCE MODULE AND LAMP EQUIPPED WITH THE SAME

This application claims the priority benefit under 35 U.S.C. §119 of Japanese Patent Application No. 2003-357827, filed on Oct. 17, 2003, which is hereby incorporated by reference.

BACKGROUND OF THE INVENTION

1. Field of the Invention

The present invention relates to a lamp and light source module. More particularly, the invention relates to a lamp that includes a reflecting mirror having a focus and that includes an LED as a light source. The lamp and light source module are particularly well adapted for use as a vehicle or vehicle related lamp.

2. Description of the Related Art

In a conventional vehicle lamp that employs LED lamps as light sources, the LED lamps are arranged in such a manner as to direct optical axes thereof to the apex of a cone. In addition, a cylindrical optical guide is attached to each LED lamp to converge light from all the LED lamps to the apex of the cone. A reflective surface of a hyperboloid of revolution is arranged near the apex to convert the light from the LED lamps into a light that is configured as if it is emitted from a single point. This is effective to form a light distribution pattern at a main reflective surface of the paraboloid of revolution and compensate for the insufficient amount of light produced by the single LED lamp (see for example Japanese Patent No. JP-A-2002/100217).

In the above conventional configuration, however, in addition to the optical guide, a casing and other structures are attached to the LED chip contained in each of the LED lamps that are arranged in a ring. Accordingly, the number of LED lamps that can be integrated is limited and a problem remains in that an insufficient amount of light is produced. For example, the conventional configuration for a lamp makes it difficult to achieve a vehicle lamp that outputs a much larger amount of light, such as a headlight.

A great deal of mutual positional accuracy is required for assembling an optical guide with reflective surface formed as a hyperboloid of revolution. In addition, a great deal of mutual positional accuracy is required for assembling the reflective surface of the hyperboloid of revolution with the main reflective surface. This high level of mutual accuracy requirement for the different structures causes other problems due to complicated process steps that elevate the cost of the vehicle lamp.

SUMMARY OF THE INVENTION

In accordance with an aspect of the present invention a light source module for a lamp can include at least two modular LEDs, and in accordance with another aspect of the invention, a lamp can be equipped with the light source module. Each modular LED can include an LED chip, a base arranged to secure the LED chip thereon, and a lens for directing or distributing light from the chip. The lens can have a focus designed to form a virtual light source image of the light from the LED chip at a certain position behind the base in the generally opposite direction of the light traveling from the chip. (The generally opposite direction of light traveling from the chip can be a variety of angled directions, and is used only to distinguish positions in front of the base from positions behind the base.) The at least two modular LEDs can be combined to superimpose at least parts of two virtual light source images that are each formed by light emitted from two LED chips such that light from the LED chips appear as a light emitted from a single light source.

According to another aspect of the present invention a light source module can include at least two modular LEDs that preferably have mutually different emission colors, including ultraviolet and infrared regions. The use of the infrared LED in combination results in both projection of a visible light and projection of an infrared light (for night-vision equipment). A combination of the three primary colors results in projection of a white light.

The formation of a plurality of LEDs having virtual light source images and the combination of the LEDs in a ring such that they are superimposed to create a particular virtual light source image can result in a single virtual light source image that emits a radial light. This is effective to solve the conventional problems associated with low flexibility of arrangement and insufficiency of light. The invention provides, among other things, a higher flexibility than the conventional art for the number and configuration for LEDs that can be arranged.

A desirable reflected light can be achieved by positioning the virtual light source(s) at the focus of the reflecting mirror. As a result, the use of light guides may not be required and the lamp can be produced with a simplified structure that results in an improved yield and a reduced cost. In addition, a desired light distribution characteristic can be easily achieved. These possible benefits are extremely effective in improving the performance of the light.

BRIEF DESCRIPTION OF THE DRAWINGS

The present invention will be more fully understood from the following detailed description with reference to the accompanying drawings, in which.

DETAILED DESCRIPTION OF PREFERRED EMBODIMENTS

Figure 1:
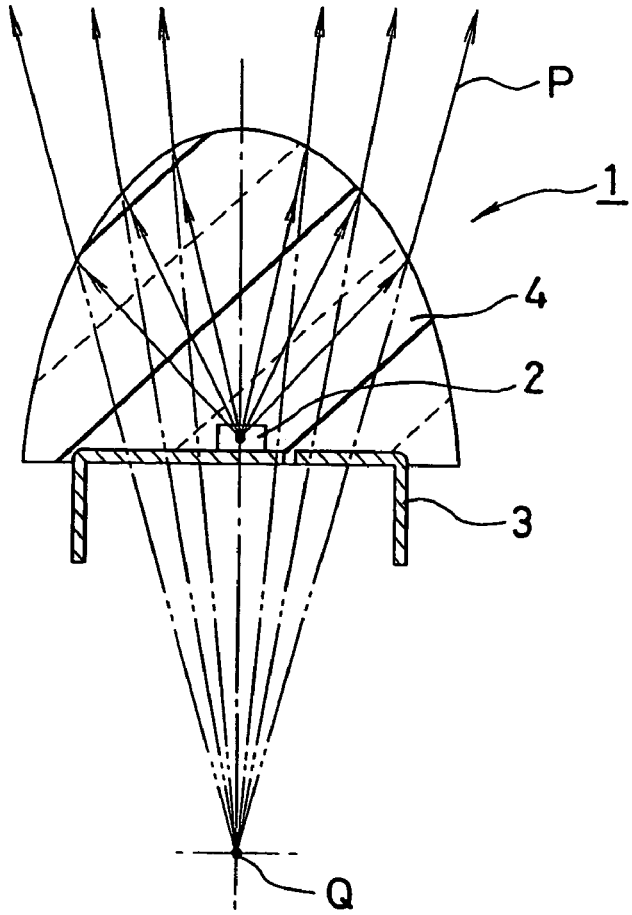
FIG. 1 is an illustrative side elevational view showing an embodiment of a modular LED made in accordance with the principles of the present invention.

The present invention will be described next in detail with reference to embodiments shown in the figures. A modular LED is denoted with the reference numeral 1 in FIG. 1. A certain number of modular LEDs 1 can be combined to form a light source module 10 that serves as a single light source for a reflecting mirror 21 in a lamp 20 (see for example FIG. 4).

The modular LED 1 can include an LED chip 2, a base 3, and a lens 4. The LED chip 2 can be die-mounted on the base 3 that preferably includes a lead frame, for example, for attachment to the lamp 20 and for supply of power to the LED chip 2 as described later.

The lens 4 can be composed of a transparent material such as an epoxy resin, which covers the LED chip 2. The lens 4 can be configured to condense the light that is emitted at a wider emission angle from the LED chip 2, and lead the light to externally emit at an appropriate emission angle (for example, 30°).

The lens 4 can be appropriately shaped to form a virtual light source image Q from the LED chip 2. The virtual light source image Q can be located at a distant position from the real position of the LED chip 2 in the modular LED 1. For example, the virtual light source image Q can be located behind the base 3 of the LED 1. A combination of a plurality of such modular LEDs 1 is suitable for forming the light source module 10. Thus, the light source module 10 can function similar to that of a single light source.

One way to accomplish the single light source effect is to cause a beam of light to travel from a point on or near the center of the LED chip 2 to the inner surface of the lens 4 (the interface with the atmosphere). When this beam reaches the inner surface, it can be refracted and directed/emitted into the atmosphere as beam P. A line extending along the beam P in the return direction can converge on a distant point Q of the virtual light source image that is preferably separated from the LED chip 2. The lens 4 can have a curvature determined to cause the beam P to take the above-described configuration. Thus, the beam P emitted from the modular LED 1 into the atmosphere appears as if it is emitted from the virtual light source image Q.

Figure 2:
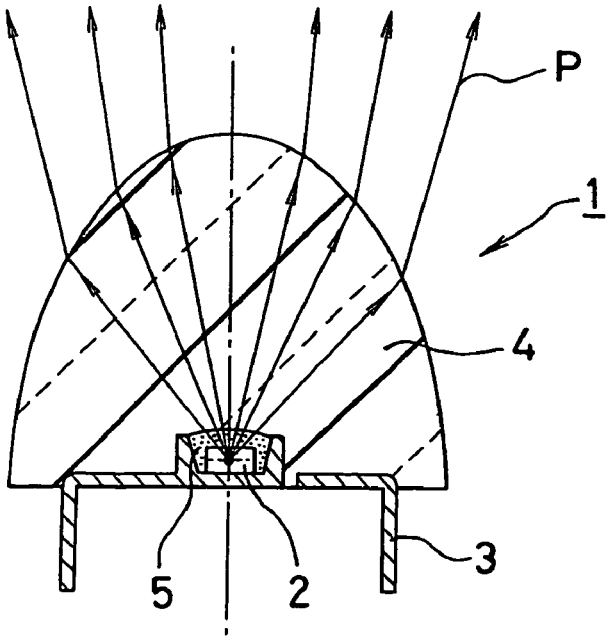
FIG. 2 is an illustrative side elevational view showing a modular LED according to another embodiment of the present invention.

FIG. 2 shows an elevational side view of a modular LED 1 in accordance with another embodiment and made in accordance with the principles of the invention. When it is desired that the modular LED 1 emit a white light, a blue LED chip 2 can be used and an appropriate amount of a yellow fluorescent material 5 can be employed to cover the emission side of the LED chip 2. Thus, the blue light emitted from the LED chip 2 can be mixed with the yellow light that originates from the fluorescent material 5 when it is excited by the blue light. As a result, the light externally radiated from the lens 4 can exhibit white characteristics.

The white modular LED 1 may include a combination of near-ultraviolet or ultraviolet LED chips 2 and fluorescent materials 5 of three wavelengths, R (red), G (green) and B (blue), which cover the LED chip 2. In any case, the lens 4 as shown in FIG. 2 can be shaped similar to the embodiment of the lens 4 as shown in FIG. 1, which is incorporated in the modular LED 1 and includes only the LED chip 2 as described above. In addition, light beams are assumed to travel from a point on or near the center of the LED chip 2 and the fluorescent material 5 to the inner surface of the lens 4. The curvature of the lens 4 can be determined based on the assumed direction of the light beams to set the location of the virtual light source image Q.

Figure 3:
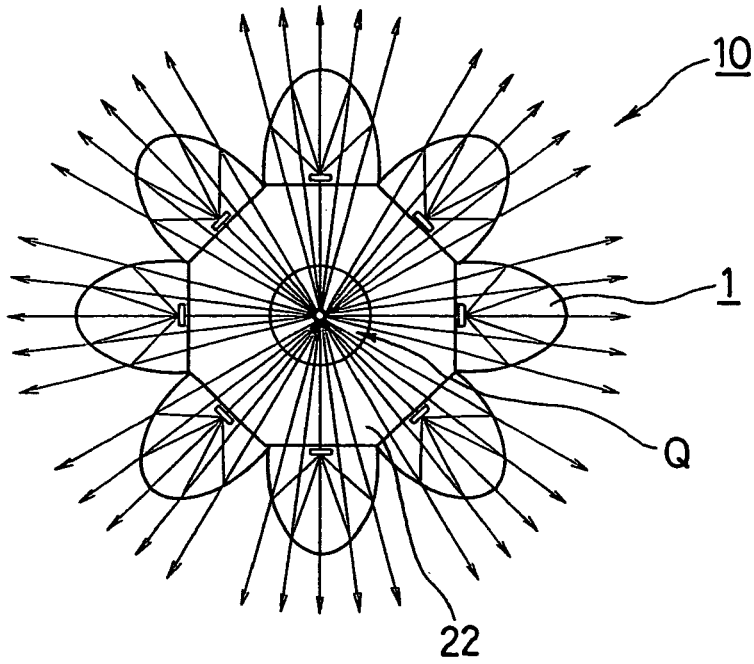
FIG. 3 is a front elevational view showing a light source module made in accordance with the principles of the present invention.

FIG. 3 shows a light source module 10 according to an embodiment of the invention that includes a plurality of modular LEDs 1 that can be formed as described above. A block 22 can be formed to have an octahedral cross-section. This block preferably has dimensions such that, when the modular LEDs 1 are attached on respective sides of the block, the virtual light source images Q are superimposed on a central axis of the block. Thus, the modular LEDs 1 can be attached on the respective sides of the block 22.

The block 22 can also serve to supply power to the modular LEDs 1. A material excellent in thermal conductivity, such as aluminum and copper, may be applied to a site of the block 22, to which the modular LED 1 is attached. In this case, the block 22 is effective in conducting and dissipating the heat radiated from the LED chip 2 when the lamp is turned on.

In the light source module 10 thus configured, the images of the modular LEDs 1 are preferably superimposed on the position of the virtual light source image Q. Therefore, the light beams emitted from all the modular LEDs 1 appear to be emitted from the position of the virtual light source image Q. This creates an effect that is equivalent to the lights being emitted from a single illuminant.

Figure 4:
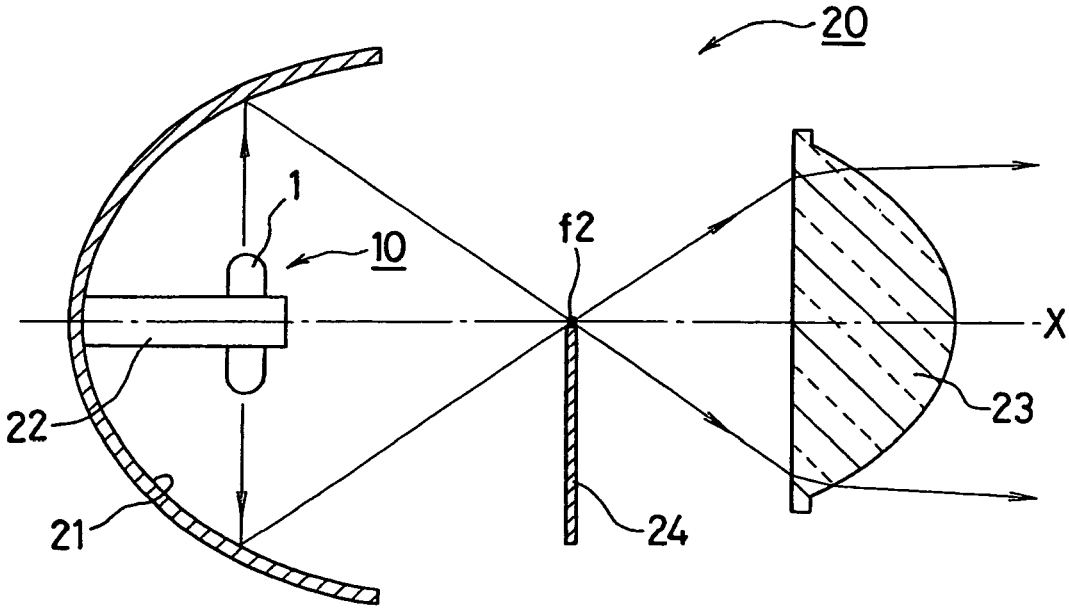
FIG. 4 is a cross-sectional view showing a lamp equipped with a light source module made in accordance with the principles of the present invention.

As shown in FIG. 4, the position of the virtual light source image Q can be matched with the first focus of the elliptical reflecting mirror 21, for example, shaped in an ellipsoid of revolution. In this case, all the beams emitted from the modular LEDs 1 converge on the second focus f2 of the reflecting mirror 21. The light source module 10, additionally equipped with a projection lens 23 and a shading plate 24, can be employed as the light source for the lamp 20. As shown in FIG. 4, the lamp 20 can be formed as a projector type for use in vehicle headlights.

Figure 5:
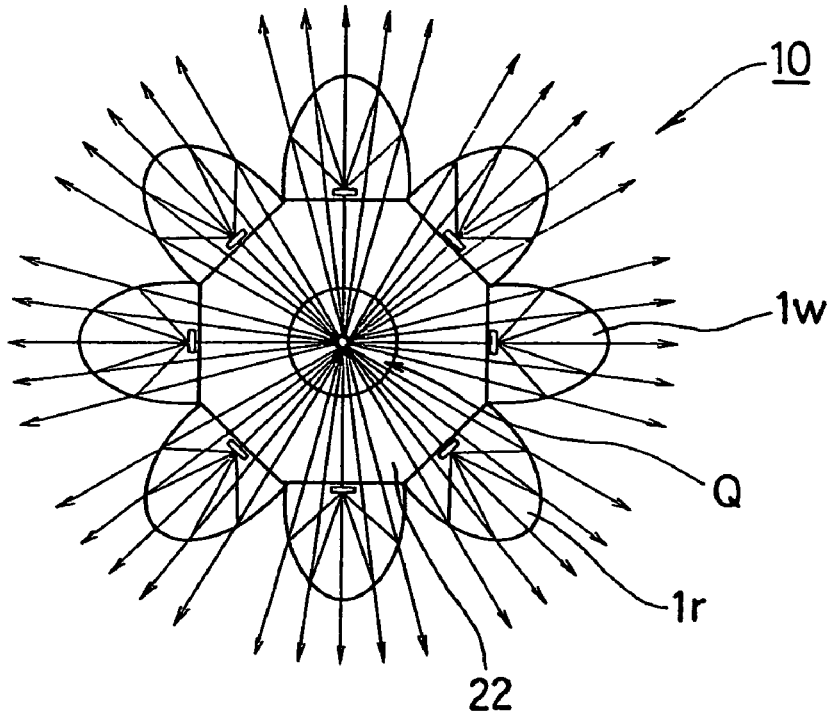
FIG. 5 is a front elevational view showing a light source module according to another embodiment of the present invention.

FIG. 5 shows a light source module 10 according to another embodiment of the present invention. The light source module 10 can be configured similar to the embodiment of FIG. 3 in that the modular LEDs can be arranged on the block 22 such that the virtual light source images Q are superimposed.

The embodiment of FIG. 5 can include two or more different types of modular LEDs, each having different emission colors, for example: a modular LED 1*w* for white light emission; and, a modular LED 1*r* for infrared light emission. In this case, the driver in the vehicle can visually confirm the vehicle direction by using the light emitted from the modular white light LED 1*w*. In addition, with the use of night-vision equipment including an infrared-imaging device that works in conjunction with the modular infrared light LED 1*r*, the driver can also confirm the direction on a monitor. Thus, the lamp 20 can project both visible light and infrared light.

The two emission colors are not limited to white and infrared light. For example, a white light modular LED 1 and a yellow light modular LED 1 can be used in conjunction with a switching circuit wired thereto to allow an operator to turn on the white light during normal driving conditions and to turn on the yellow light in fog. Thus, the lamp 20 can serve as a front fog lamp. Further, the color can be dimmed when the white and yellow lights are simultaneously turned on and the currents flowing in these LEDs are adjusted.

Figure 6:
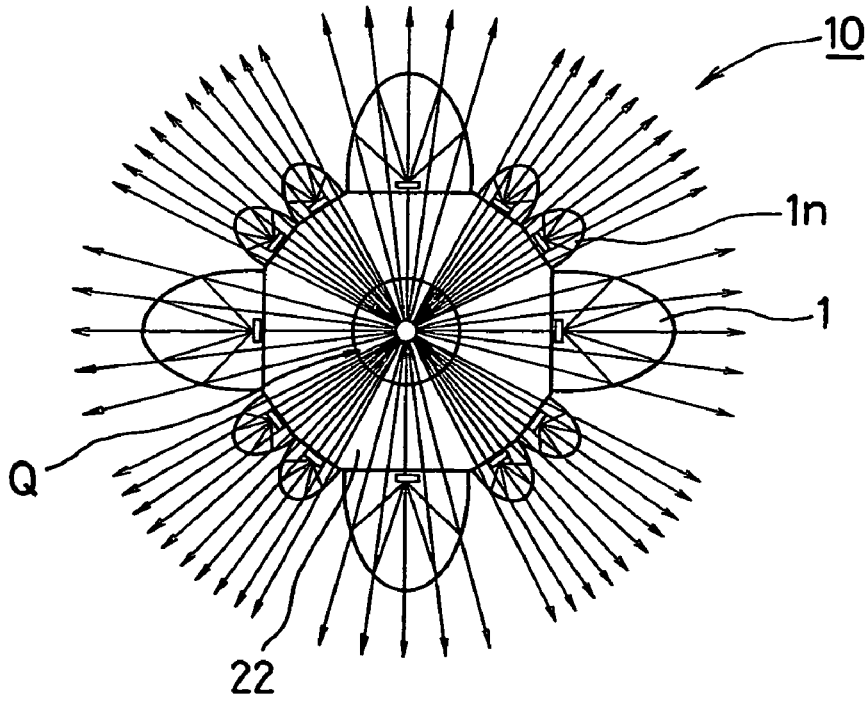
FIG. 6 is a front elevational view showing a light source module according to yet another embodiment of the present invention.

FIG. 6 shows a light source module 10 according to another embodiment of the present invention. A modular LED 1 can be used even though it has a different emission color. In the embodiment of FIG. 6, another modular LED 1*n* can be combined with the modular LED 1 as described above with respect to the embodiments of FIGS. 3 and 5. In the modular LED 1*n*, the distance from the base 3 to the virtual light source image Q (hereinafter referred to as a virtual light source image distance) can be the same while the lens 4 has a smaller diameter compared to the modular LED 1.

The modular LED 1*n* with the substantially same virtual image distance and smaller diameter has a narrower emission angle of light, but has a smaller curvature of the lens 4 at the same time. Accordingly, the lens can have a higher convergence and an increased amount of light per area. As obvious from FIG. 6, the number of the modular LEDs 1*n* arranged in a portion can be increased depending on the reduced extent of the diameter. Therefore, the beam density at this portion can be increased such that it is higher than the portion with the standard modular LEDs 1 arranged therein.

Thus, the high-density beam can be emitted in a direction through arrangement of the small-diameter modular LED 1*n*.

Accordingly, when the small-diameter modular LED 1*n* is arranged on a position corresponding to a part of the reflecting mirror 21 that distributes light to a location that requires a higher intensity of illumination on the light distribution pattern (such as the front of the vehicle), the higher intensity can be easily achieved.

Figure 7:
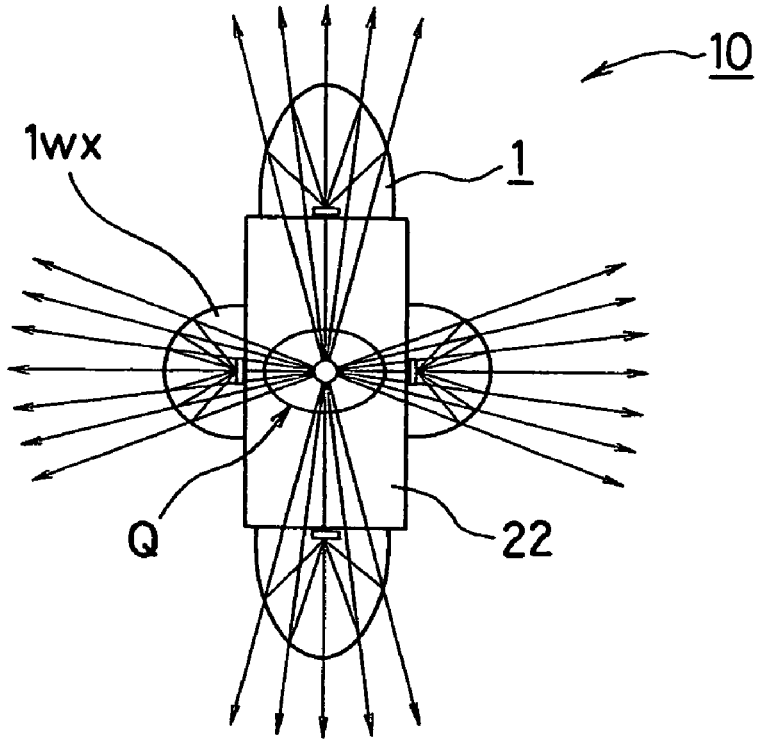
FIG. 7 is a front elevational view showing a light source module according to still another embodiment of the present invention.

FIG. 7 shows a light source module 10 according to another embodiment of the present invention. In the embodiment of FIG. 7, the diameter of the lens 4 may be unchanged while the distance from the base 3 to the virtual light source image Q (virtual light source image distance) is changed. Modular LEDs 1*wx* that have a shorter virtual light source image distance can be used in combination with the standard modular LEDs 1.

Thus, the magnification of the virtual light source image Q varies depending on the virtual light source image distance (focal distance) of the lens 4, and appears as a flat shape with a different aspect ratio, as shown in FIG. 7. This shape can be focused on the second focal position and projected through the projection lens 23 (see FIG. 4). Accordingly, even if the reflecting mirror 21 is shaped in the ellipsoid of revolution, the lamp can provide a horizontally wider and vertically narrower shape that may be preferable for the light distribution characteristic of a vehicle lamp.

As described above, plural modular LEDs can be employed to provide a single virtual light source. Therefore, an increased amount of light can be provided by an increased number of LEDs, resulting in a high-density arrangement and a downsized lamp. Despite the use of plural modular LEDs, a substantially single or totally single light source can be provided. This is effective for clear positioning of the light source relative to the reflecting mirror and simplification of the structure.

Such a configuration is also effective to provide, among other benefits, a combination of two or more emission colors in an LED; a plurality of available uses; a reduced number of lamps by a combined use; and an ideal light distribution characteristic achieved by a lens modified in a modular LED.

While the invention is described as being appropriate for vehicle lamps, it should be understood that the invention is also suited for various other types of lamps, including vehicle and traffic signal lamps, search lamps, spotlights, flashlights and other various lamps.

Having described embodiments consistent with the principles of the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A light source module for a lamp, comprising:

at least two LEDs, each LED including an LED chip capable of producing light in a light emitting direction, a base arranged to secure said LED chip thereon, a lens, and a reflector located adjacent the at least two LEDs, wherein said lens is configured to cause refraction of light from the LED chip at an inner surface of the lens to form a virtual light source image of said light from said LED chip at a certain position behind said base in a direction generally opposite the light emitting direction from said chip, wherein said at least two LEDs are configured such that at least a portion of light emitted from each of the LEDs combines to superimpose at least parts of two virtual light source images each formed by light emitted from two LED chips such that light from the LED chips appears as a light emitted from a single light source, wherein the reflector and the LEDs are configured such that the portion of light combines after being reflected by the reflector, and wherein a distance from said virtual light source image to said lens is substantially the same for each of the LEDs, and the diameter of one lens of said LEDs is different from the diameter of at least one other lens of said LEDs.

2. The light source module according to claim 1, wherein said at least two LEDs have mutually different emission colors including ultraviolet and infrared regions.

3. The light source module according to claim 1, further comprising:

a block configured for attachment to said LEDs, the block including a thermally conductive material and shaped in a substantial prism having a substantially polygonal cross-section, said block capable of radiating heat from said LEDs.

4. The light source module according to claim 1, wherein the LEDs are modular LEDs.

5. The light source module according to claim 1, further comprising:

a block configured for attachment to said LEDs, the block including a central longitudinal axis that intersects the position of the virtual light source image.

6. A light source module for a lamp, comprising:

at least two LEDs, each LED including an LED chip capable of producing light in a light emitting direction, a base arranged to secure said LED chip thereon, a lens, and a reflector located adjacent the at least two LEDs, wherein said lens is configured to cause refraction of light from the LED chip at an inner surface of the lens to form a virtual light source image of said light from said LED chip at a certain position behind said base in a direction generally opposite the light emitting direction from said chip, wherein said at least two LEDs are configured such that at least a portion of light emitted from each of the LEDs combines to superimpose at least parts of two virtual light source images each formed by light emitted from two LED chips such that light from the LED chips appears as a light emitted from a single light source, wherein the reflector and the LEDs are configured such that the portion of light combines after being reflected by the reflector, and wherein a distance from said virtual light source image to said lens of a first LED of said LEDs is different from a distance from said virtual light source image to said lens of a second LED of said LEDs.

7. The light source module according to claim 6, further comprising:

a block configured for attachment to said LEDs, the block including a thermally conductive material and shaped in a substantial prism having a substantially polygonal cross-section, said block capable of radiating heat from said LEDs.

8. A lamp, comprising:

at least two LEDs, each LED including an LED chip capable of producing light in a light emitting direction, a base arranged to secure said LED chip thereon, a lens, and a reflector located adjacent the at least two LEDs;

a projection lens located adjacent the reflector and configured to project the combined light from the at least two LEDs forward; and a shading plate disposed between the reflector and the projection lens, wherein said lens has a focus configured to form a virtual light source image of said light from said LED chip at a certain position behind said base in a direction generally opposite the light emitting direction from said chip, wherein said at least two LEDs are configured such that at least a portion of light emitted from each of the LEDs combines to superimpose at least parts of two virtual light source images each formed by light emitted from two LED chips such that light from the LED chips appears as a light emitted from a single light source, wherein the reflector and the LEDs are configured such that the portion of light combines after being reflected by the reflector, wherein all beams emitted by the at least two LEDs converge on a second focal point located adjacent the shading plate, and wherein a distance from said virtual light source image to said lens is substantially the same for each of the LEDs, and the diameter of one lens of said LEDs is different from the diameter of at least one other lens of said LEDs.

9. The lamp according to claim 8, wherein said at least two LEDs have mutually different emission colors including ultraviolet and infrared regions.

10. The lamp according to claim 8, further comprising:

a block configured for attachment to said LEDs, the block including a thermally conductive material and shaped in a substantial prism having a substantially polygonal cross-section, said block capable of radiating heat from said LEDs.

11. The lamp according to claim 8, further comprising a reflecting mirror configured to superimpose light emitted from the LEDs in an emission direction as a single light source.

12. The lamp according to claim 8, further comprising a reflecting mirror that includes a focus located substantially at the position of the virtual light source image.

13. The lamp according to claim 8, wherein the lamp is a vehicle lamp and the LEDs are modular LEDs.

14. A lamp, comprising:

at least two LEDs, each LED including an LED chip capable of producing light in a light emitting direction, a base arranged to secure said LED chip thereon, a lens, and a reflector located adjacent the at least two LEDs;

a projection lens located adjacent the reflector and configured to project the combined light from the at least two LEDs forward; and a shading plate disposed between the reflector and the projection lens, wherein said lens has a focus configured to form a virtual light source image of said light from said LED chip at a certain position behind said base in a direction generally opposite the light emitting direction from said chip, wherein said at least two LEDs are configured such that at least a portion of light emitted from each of the LEDs combines to superimpose at least parts of two virtual light source images each formed by light emitted from two LED chips such that light from the LED chips appears as a light emitted from a single light source, wherein the reflector and the LEDs are configured such that the portion of light combines after being reflected by the reflector, wherein all beams emitted by the at least two LEDs converge on a second focal point located adjacent the shading plate, and wherein a distance from said virtual light source image to said lens of a first LED of said LEDs is different from a distance from said virtual light source image to said lens of a second LED of said LEDs.

15. The lamp according to claim 14, further comprising:

a block configured for attachment to said LEDs, the block including a thermally conductive material and shaped in a substantial prism having a substantially polygonal cross-section, said block capable of radiating heat from said LEDs.

16. The lamp according to claim 14, further comprising a reflecting mirror configured to superimpose light emitted from the LEDs in an emission direction as a single light source.

17. The lamp according to claim 14, further comprising a reflecting mirror that includes a focus located substantially at the position of the virtual light source image.

18. The lamp according to claim 14, wherein the lamp is a vehicle lamp and the LEDs are modular LEDs.

* * * * *